US012076781B2

(12) United States Patent
Ettemeyer et al.

(10) Patent No.: US 12,076,781 B2
(45) Date of Patent: Sep. 3, 2024

(54) DEVICE AND METHOD FOR MANUFACTURING COMPONENTS

(71) Applicant: Fraunhofer-Gesellschaft zur Förderung der angewandten Forschung e.V., Munich (DE)

(72) Inventors: Florian Ettemeyer, Augsburg (DE); Daniel Günther, Bremen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 0 days.

(21) Appl. No.: 17/774,365

(22) PCT Filed: Nov. 2, 2020

(86) PCT No.: PCT/EP2020/080709
§ 371 (c)(1),
(2) Date: May 4, 2022

(87) PCT Pub. No.: WO2021/089489
PCT Pub. Date: May 14, 2021

(65) Prior Publication Data

US 2022/0355370 A1 Nov. 10, 2022

(30) Foreign Application Priority Data

Nov. 5, 2019 (DE) ..... 10 2019 217 038.2

(51) Int. Cl.
*B22C 9/20* (2006.01)
*B22C 9/04* (2006.01)
*B22C 9/08* (2006.01)

(52) U.S. Cl.
CPC ..... *B22C 9/20* (2013.01); *B22C 9/04* (2013.01); *B22C 9/088* (2013.01)

(58) Field of Classification Search
CPC ..... B22C 9/20; B22C 9/04; B22C 9/088
See application file for complete search history.

(56) References Cited

U.S. PATENT DOCUMENTS 4,044,818 A 8/1977 Larkin
4,549,600 A * 10/1985 Kauserud ..... B22D 35/00 164/323

(Continued)

FOREIGN PATENT DOCUMENTS

CH 586082 A5 3/1977
DE 19647326 A1 5/1997

(Continued)

OTHER PUBLICATIONS

English Machine Translation of DE 102016201824 A1 (Year: 2017).*

(Continued)

*Primary Examiner* — Kevin P Kerns
*Assistant Examiner* — Steven S Ha
(74) *Attorney, Agent, or Firm* — Faegre Drinker Biddle & Reath LLP

(57) ABSTRACT

The invention relates to a device and a method for producing components comprising a mould building device (1) for producing lost casting moulds, and a casting device (2) connected to the mould building device for casting components in the lost casting moulds, characterised in that the mould building device is suitable for the continuous layering of moulding plates (3, 4, 5, 6, 7, 8, 9, 10, 11, 12, 13, 14, 15, 16, 17, 18, 19, 20, 21, 22, 23), wherein a respective at least three of said moulding plates form a casting mould.

11 Claims, 6 Drawing Sheets

(56) References Cited

U.S. PATENT DOCUMENTS

| | | | |
|---|---|---|---|
| 5,904,203 | A | 5/1999 | Mai et al. |
| 2005/0109478 | A1 | 5/2005 | Hunter et al. |

FOREIGN PATENT DOCUMENTS

| | | | |
|---|---|---|---|
| DE | 102016201824 | A1 | 8/2017 |
| DE | 102016202657 | A1 | 8/2017 |
| FR | 0800748 | A | 7/1936 |
| GB | 1462867 | A | 1/1977 |

OTHER PUBLICATIONS

International Search Report and Written Opinion received for PCT Patent Application No. PCT/EP2020/080709, mailed on Jan. 26, 2021, 21 pages (10 pages of English Translation and 11 pages of Original Document).

* cited by examiner

DEVICE AND METHOD FOR MANUFACTURING COMPONENTS

CROSS REFERENCE TO RELATED APPLICATIONS

The present application is a national stage application of International Application No. PCT/EP2020/080709, filed Nov. 2, 2020, which claims priority to German Application No. DE102019217038.2, filed Nov. 5, 2019, the disclosures of which are hereby incorporated by reference in their entireties.

FIELD OF THE DISCLOSURE

The present invention is in the field of mechanical engineering and foundry technology and general process engineering and can be used with particular advantage in series production.

BACKGROUND OF THE DISCLOSURE

It has long been known to produce components by casting in lost molds which can be removed after the casting process. Such components are also mass-produced in which the same or similar lost casting molds are mass-produced and used on the basis of models.

It is also already known to automatically produce lost casting molds in series, said lost casting molds being subsequently reused in an automatic casting process in series production of components/castings. The molds can be crushed and reused after their destruction.

SUMMARY

Against the background of the prior art, the present invention is based on the object of creating a device and a method of the type mentioned at the beginning, with which the cost of manufacturing components can be reduced even further, wherein the flexibility in the selection of the shapes of components that can be produced should at least remain the same if not increased.

The object is achieved by means of the features of the invention by a device for producing components comprising a mold building device for producing lost casting molds and a casting device connected to the mold building device for casting components in the lost casting molds, in which the mold building device is suitable for the continuous layering of molding plates, wherein a respective at least three of said molding plates form a casting mold.

The mold building device in this case is basically suitable for producing parts of lost casting molds using a basic molding material. The casting molds in this case are composed of layered molding plates that can be produced individually within the mold building device or in an upstream facility and joined together into layer stacks in the mold building device. At least three such molding plates each form a casting mold. Complicated casting molds can also be assembled by using more than two molding plates, wherein each of the molding plates can have a simple design. Curved inner contours of the cavities in the casting molds can, for example, be assembled in stages. However, the molds within the individual molding plates can also be inclined or curved. Contours of the individual molding plates preferably run such that they can each be designed without undercuts.

After their production, the individual molding plates can, for example, be deburred or ground in order to ensure that different molding plates can be assembled without gaps. More than three molding plates, for example, at least five or ten molding plates, can also be used for a casting mold.

The molding plates can be produced within the mold building device or a separate facility using the basic molding materials sand, bauxite, chrome ore, ciphalite, artificial mullite, hollow spheres, expanded glass, ores, ceramic powder, artificial sand, metal particles, iron filings, copper filings, aluminum particles, steel particles or mixtures of said materials. Molding material binders can be used to hold the parts/particles of a single molding plate together. The following substances are suitable therefor: bentonite, binder clay, as chemical binders: inorganic water glass, furan resins, phenolic resins, cold box polyurethanes, acrylate binders, epoxy resins, polyester, polyvinyl, polyhydric alcohols, soluble polymer binders; in addition: salts, salt binders, cyanoacrylates, cellulose, acetate, sugar dextrose, cements, phosphate cement, gypsum, hemihydrates, quicklime, alginates, silicones, ethyl silicates, linseed oil binders, core oils, starch binders, coning sand binders, resols, novolaks, geopolymer binders.

In order to produce solid molding plates, the basic molding materials are mixed with the molding material binders and then solidified. The shaping can be done, for example, by blowing in, sieving, scattering, 3D printing with simultaneous structuring. A cuboid, cylindrical, prismatic or other shaped molding box can be used for shaping, wherein positive-locking elements for aligning different molding plates can be attached to one another during molding at the same time as the cavities of the casting mold.

The plates can be compacted by pressing, rolling, hydraulic or pressure hammering and hardened by heat, chemical reactions, radiation, gassing or the application of compressive force.

After the above treatments, the molding plates can be finished or generally filled with an additional material. The plates can be milled flat or ground and cooling irons can be inserted into the molding plates.

The individual molding plates can be structured using a variety of known processing methods, for example, suction, scratching, punching, fine blanking, embossing, milling, sawing, eroding, targeted local burning of the binder, core shooting, shaping using a tool, ultrasonic contouring, grinding, loosening by chemical solvents, drilling, debinding (by breaking the bond), 3D printing, wherein the processing can be single-sided, double-sided and each with or without undercuts.

The prefabricated molding plates are joined together into a layer stack within the mold building device. The individual layers/molding plates follow one another in a stacking direction in the joined-together stack. The stacking direction in this case can be arranged horizontally, so that the individual molded plates are arranged next to one another on a base. To form a stack, the molding plate to be added can be pushed against the already existing stack in the stacking direction. A molding plate can also be pushed into its position perpendicular to the stacking direction. The stacking direction in this case can run horizontally or vertically. It is also possible for a plurality of molding plates to be joined together outside the mold building device and inserted into a stack or a layer sequence inside the mold building device. Different molding plates can also be pushed into the stack from different directions within the mold building device. This can be useful, for example, if molding plates are manufactured at different points within the mold building device or are made available for joining together.

In principle, the individual molding plates can be moved within the mold building device by hydraulic or pneumatic slides or by electric slides. A drivable base can also be provided, on which the molding plates rest and are moved at least temporarily. Gravity can also cause molding plates to slip into their intended position on inclined planes.

Stacking of molding plates is thus possible within the mold building device, wherein at least three molding plates are brought together to form a layer stack. The stacking direction can be changed at times, so that a horizontal layer stack can adjoin a vertical layer stack.

Various molding plates are joined together within the individual layer stack, wherein at least two end plates are provided in each case, at which end plates the cavity of the respective casting mold to be shaped ends.

In addition, different casting molds can be produced in such a mold building device, in which different layer stacks are produced using respectively different sets of molding plates. Such a change of casting molds in continuous production is possible with extremely little effort, as only a single or a few molding plates are exchanged when stacking.

Provision can also be made for the mold building device to be suitable for producing molding plates individually, which each delimit a cavity of a casting mold on at least one, in particular on two of their sides.

In such a case, a plurality of casting molds are formed with a minimum number of molding plates by using the molding plates lying between the different casting molds for a plurality of casting molds at the same time.

It can also advantageously be provided for the mold building device to have an infeed device for moving individual molding plates to form a stack of molding plates, and an alignment element on which the molding plates can be aligned, and/or for the mold building device to have at least one tool for shaping positive-locking elements on the molding plates, wherein the positive-locking elements each enable the alignment of a molding plate on a molding plate directly adjacent thereto.

Such an infeed device can, on the one hand, have slides for pushing molding plates, but, on the other hand, said infeed device can also have gripping arms of robots. The molding plates can be placed on a common base in order to find a common alignment in a target position. A rail or edge can also serve as an alignment element. The molded plates can have positive-locking elements on the sides facing each other in order to align the molding plates with one another. Such positive-locking elements can have, for example, webs and grooves or pins and bores, cones and depressions and similar complementary geometric shapes.

The mold building device can be adapted to move, for example, slides for feeding molding plates along the stack in order to insert molding plates at different points in a layer stack. However, as part of the mold building device, a conveying element, for example, a conveyor belt, can also be provided, onto which the molding plates are pushed. Such a conveying element can, for example, also be designed elastically such that it automatically contracts behind the point at which the molding plates are joined together and thus exerts a compression effect on the molding plates for compression or for holding the stack together.

A conveying element can also be provided in the casting device downstream of the mold building device, which casting device moves the individual casting molds past a crucible or a spout for the melt, or such a crucible or a spout can be movable relative to the layer stack, or both, in order to fill the casting molds one after the other. Finally, it can also be provided that a demolding device is arranged downstream of the casting device.

The mold building device can also have a hydraulic, pneumatic, electric, or spring-driven device for pressing different molding plates together in the stacking direction. The molding plates can, for example, be glued, bolted or clamped to one another for their connection in order to join them together permanently to form casting molds.

Within the casting device, the crucible or a spout can be displaceable perpendicularly to the stacking direction and/or in the stacking direction in order, for example, to serve different feeders/sprues. A plurality of casting devices in the form of crucibles or pouring devices can also be provided.

In the demolding device downstream of the casting device, after the cast components have solidified, the molds can be destroyed or crushed, for example, by smashing using a hammer, tumbling, dissolving with solvents, ultrasound, shock waves, explosions or vibrations.

The produced components can then be removed by standard handling equipment such as cranes or robots, or by hand.

In addition to a device of the type explained above, the invention also relates to a method for producing castings, in which molding plates are first produced and automatically continuously layered in a mold building device, wherein each casting mold is formed by at least three molding plates delimiting a common cavity and wherein a casting material is poured into the casting molds within a casting device connected to the mold building device.

In particular, it can be provided that the mold building device is arranged in a fixed manner and that the individual molding plates are placed on a drivable conveying element, in particular a conveyor belt, and/or that the molding plates layered to form casting molds are moved relative to the casting device by means of a drivable conveying element.

It can be provided that a continuous conveying element, for example, in the form of a conveyor belt, is provided for moving molding plates within the mold building device and for their onward transport to and in the casting device. However, it can also be provided that an intermediate store or buffer for the casting molds is provided between the mold building device and the casting device in order to compensate for a temporary standstill of one of the two devices and to be able to continue operating the other device.

For this purpose, it can also be provided for an infeed device of the mold building device to move along the stack of molding plates and/or for a crucible of the casting device to move along the stack of molding plates in order to activate individual casting mold.

Both the mold building device and the casting device thus become more flexible, especially when the casting molds are lined up continuously and are moved on as a continuous row directly into the casting device.

The casting device can be movable at least with a melting crucible or a pouring device along the stacking direction or also perpendicular thereto in order to reach different pouring openings of the casting molds or to supply a plurality of casting molds with a casting material in one pass.

In order to reduce the number of molding plates to be handled and produced as much as possible, provision can also be made for individual molding plates to be used for a plurality of adjacent casting molds and/or for casting cores to be integrated into the molding plates.

Casting cores can also be integrated into the molding plates by suspending the casting cores on webs in recesses in the molding plates. This can be achieved, for example, by appropriate milling or other machining in which the webs remain between the cores and the outer parts of the molding plates.

Cores having materials different from the material of the molding plates, for example, having metal wires or carbon fibers, can also be suspended inside the molding plates. The corresponding wires, fibers or other strand-like elements can be pulled out of the castings after the casting process. In some cases, continuous openings created in this way in castings can be used practically, for example, by inserting electrical cables or light guides.

Provision can also be made for mold covers, each having at least one funnel and/or feeder, to be placed on one or more molding plates after layering such that the funnel and/or feeder is/are connected to at least one cavity of a casting mold.

Such a mold cover can have the shape of a plate or a cuboid, for example, and be provided with positive-locking elements for alignment with the molding plates. Such a mold cover can also have a U-shaped cross section, so that the legs of the U rest laterally on the molding plates and, on the one hand, can hold the molding plates together and, on the other hand, can align the mold cover on the molding plates.

In addition to a device for producing components and a corresponding method, the invention also relates to a layer stack, in particular a continuous layer stack, of molding plates that form a plurality of casting molds, wherein two, three or more molding plates form a casting mould and wherein at least one molding plate in each case forms a part of two casting molds that are directly adjacent to one another and delimits two cavities of different casting molds.

Such a mold stack implements a plurality of casting molds in the simplest possible way, using a number of molding plates that is kept as small as possible. Such a layer stack can also contain elements for holding the adjacent molding plates together, such as clamps, bolts or glue.

BRIEF DESCRIPTION OF THE DRAWINGS

The invention is shown below using exemplary embodiments in figures of a drawing and then described.

DETAILED DESCRIPTION OF THE DRAWINGS

Figure 1:
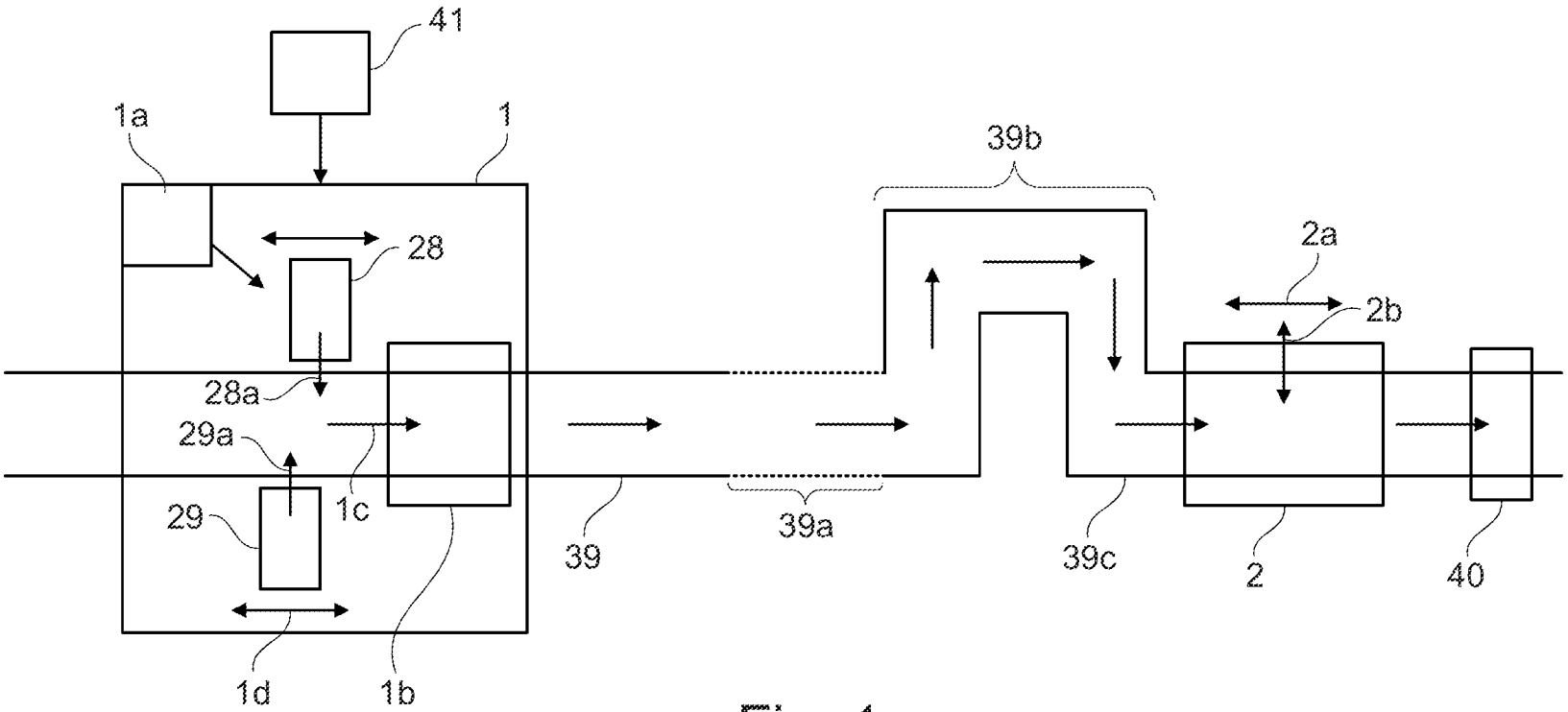
FIG. 1 illustrates an overview of a device according to the invention in schematic form, FIG. 2 schematically illustrates a device for the production of molding plates.

FIG. 1 schematically shows a device for producing castings comprising a mold building device 1, a casting device 2 and a demolding device 40. The mold building device 1 contains, for example, a device 1*a* for producing individual molding plates, which are stacked on a conveyor belt 39 after production. For this purpose, the molding plates are placed or positioned on the conveyor belt by means of one or more feed devices 28, 29 in the direction of the arrows 28*a*, 29*a*, where they form a layer stack.

The molding plates can be compressed and connected together in a compression device 1*b* in the stacking direction shown by the arrow 1*c*.

For this purpose, the individual molding plates can be provided, for example, with pins and bores which engage in one another and, on the one hand, serve for aligning adjacent molding plates with one another and, on the other hand, for connecting the molding plates to one another. The molding plates can also be connected to one another by means of continuous bolts or external clamps or glued to one another. The clamps can in each case overlap adjacent molding plates or a larger number than two molding plates.

Within the compression device 1*b*, slides or pivotable cheeks can be provided, which compress the layer stack in the stacking direction 1*c*.

The conveyor belt 39 moves in the direction 1*c* and transports the molding plates continuously or intermittently.

The infeed devices 28, 29 can also be driven, for example, along the conveyor belt 39 in the directions indicated by the arrow 1*c* and/or perpendicularly thereto (arrow 1*d*).

In addition to a device 1*a* for producing molding plates, the mold building device 1 can also process and feed additional or alternative molding plates, which are delivered prefabricated by a conveying device 41. Molding plates that are prefabricated and those manufactured in the mold building device 1 itself can also be joined together mixed within a layer stack and, for example, consist of different materials or have different dimensions, in particular different thicknesses.

The conveyor belt 39 can be, for example, a continuous conveyor belt and can be moved continuously or intermittently. It can be ensured by means of an intermittent movement, for example, that the infeed devices 28, 29 can insert the molding plates without gaps, in particular when the infeed devices cannot be moved along the conveyor belt 39.

The conveyor belt 39 or an alternative conveying element can have elasticity in the longitudinal direction, for example, so that said conveyor belt can exert a direction of compression in the stacking direction 1*c* on the molding plates placed thereon.

An interruption of the conveyor belt or a termination of a first conveyor belt, a bearing point and the start of a second conveyor belt can also be provided in the section 39*a* of the conveyor belt shown in dashed lines, for example, in order to be able to compensate for irregularities in the speed of equipping the conveyor belt with molding plates.

The same applies to the loop 39*b* of the conveyor belt, which makes it possible to store an increased stock of molding plates on the conveyor belt with a non-increased space requirement.

The section 39*c* of the conveyor belt passes through a casting device 2 in which a device for pouring molten casting material is provided, which device pours the casting material into molds formed by the molding plates. A pouring element in the form of a crucible can, for example, be movable along the conveyor belt 39*c*, as indicated by the arrow 2*a*, and/or also perpendicularly thereto, as indicated by the arrow 2*b*, in order to reach different feeders or casting funnels of the casting molds.

In the further course of the conveyor belt 39*c*, a demolding device 40 is provided behind the casting device 2, in which demolding device 40 the solidified castings are freed from the casting molds. This happens, for example, by smashing, shaking or chemically dissolving the material of the casting molds. The casting molds can also be acted upon by vibration, explosion, radiation, hammering or solvents. If planned, cores of the casting molds can also be removed by core marks after the crushing.

In another embodiment, not shown, the device can also do without a conveyor belt if the mold building device itself is movable and successively builds up a layer stack of molding plates. Such a mold stack can then be driven over using a transportable casting device in order to fill the casting molds with molten casting material. For continuous operation, the layer stack can form a closed line overall, for example, or said layer stack can be arranged along a finite path, wherein both the mold building device and the casting device start again at the other end of the layer stack after the end of travel on the layer stack. A multi-directional mold building device and casting device are necessary for this purpose.

FIGS. 2 to 7 show part of a mold building device in which molding plates 3 can be produced individually. Said part of the mold building device is denoted in FIG. 1 by the reference numeral 1*a*.

Figure 2:
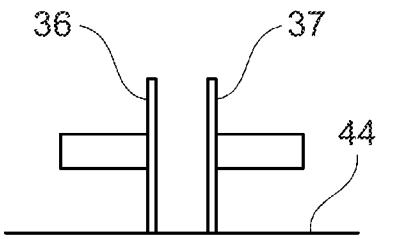

For this purpose, as shown in FIG. 2, two compression elements 36, 37 having the form of flat, displaceable plates are provided, for example, on a base 44 which is also flat. The flat plates 36, 37 are provided with stamps which can be displaced parallel to the surface of the base 44 or can be acted upon with force for compression.

Figure 3:
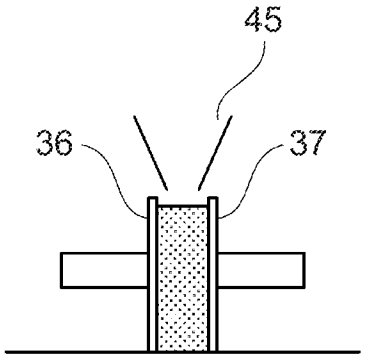
FIGS. 3 to 7 illustrate different states in the course of the production of a molding plate.
Figure 4:
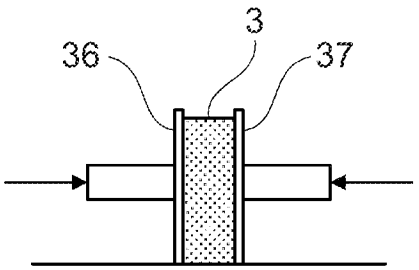

FIG. 3 shows that a molding material in the form of a bulk material is filled between the compression elements 36, 37 through a funnel 45 shown schematically.

The intermediate space between the compression elements 36, 37 is also closed off by lateral delimiting elements, which are not shown in the figures, so that a box-shaped container is formed overall.

After filling in the molding material, which usually consists of a mixture of solid particles and binder material, a compression force can be exerted by the compression elements 36, 37, so that the molding material is compressed, compacted and solidified with the binder. The molding material can further be acted on by other means already described above, such as heat, radiation or the like, in order to solidify the molding material into a molding plate 3.

Figure 5:
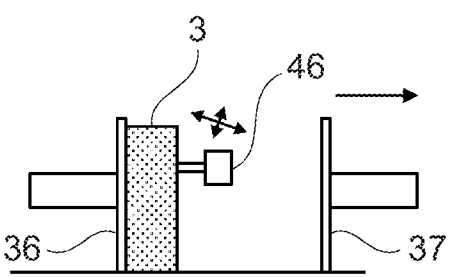

FIG. 5 shows that after the molding plate 3 has solidified, the right compression element 37 is moved away from the molding plate in order to create a machining space in which a machining tool 46 can machine the molding plate 3 and create cavities therein. The machining tool 46 can be, for example, a milling head that can be moved in all directions, or a laser or an erosion electrode for removing material. The binder can also be locally dissolved, thereby removing material, by means of the tool.

Figure 6:
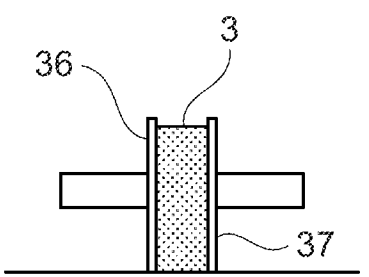
Figure 7:
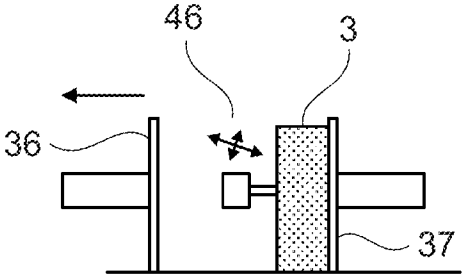

If the desired cavities have been introduced into the molding plate 3 from the side of the compression element 37, the compression elements 36, 37 can be brought closer together again, as is shown in FIG. 6, and then as shown in FIG. 7, the left compression element 36 can be moved away from the molding plate in order to introduce further cavities into the molding plate 3 from this side using a machining tool 46.

Figure 8:
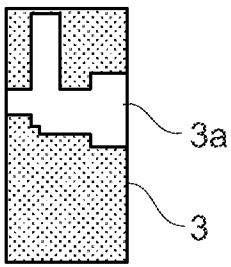
FIG. 8 illustrates a molding plate in cross section.

A finished molding plate provided with cavities is shown by way of example by the reference numeral 3 in FIG. 8 in a cross section.

The recess 3*a* represents a part of a cavity of a casting mold created by joining together a plurality of molding plates.

Figure 9:
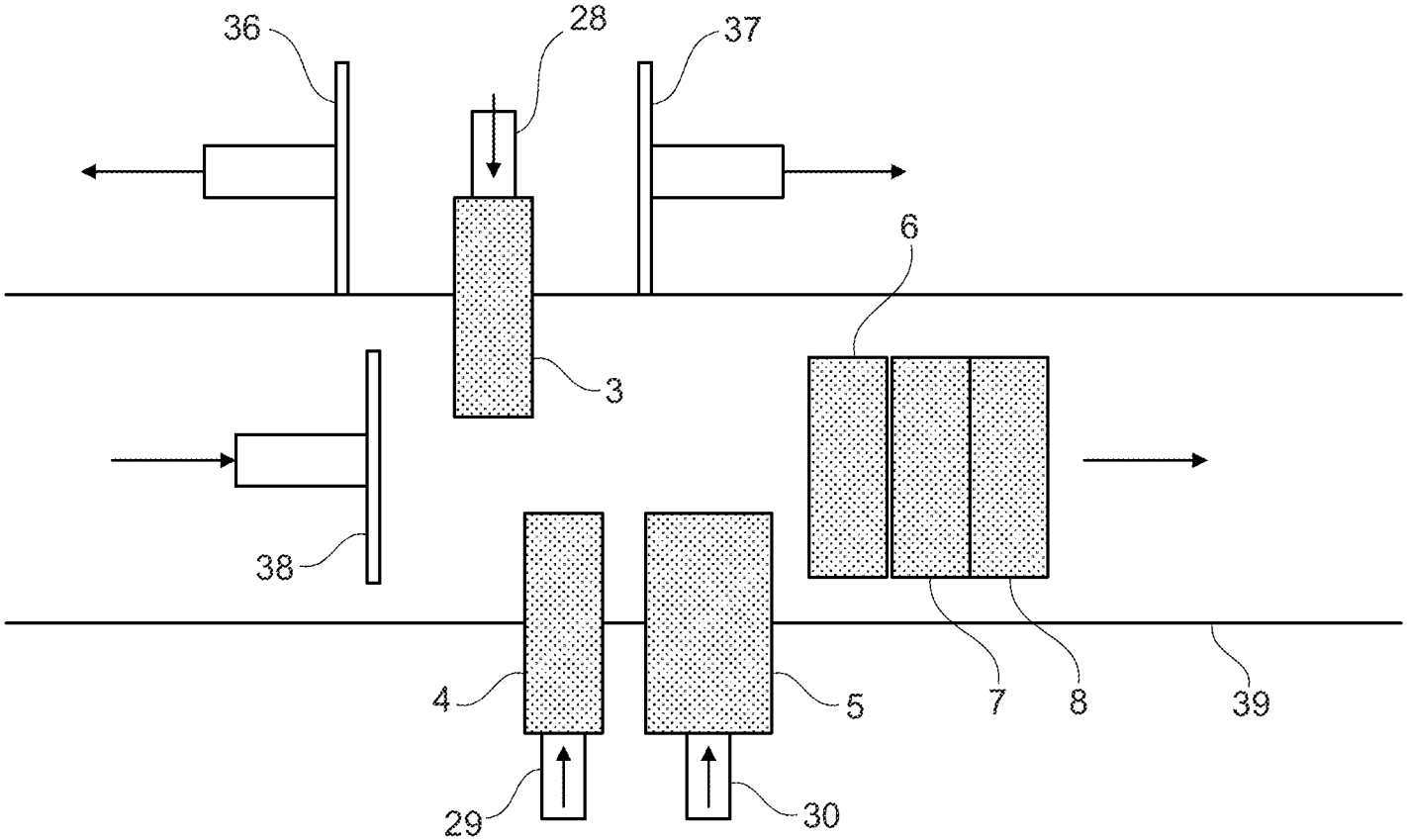
FIG. 9 illustrates parts of a mold building device with a plurality of infeed devices for molding plates.

FIG. 9 shows in detail an exemplary structure of an infeed device for the molding plates. Compression elements 36, 37 are shown in the upper region, between which compression elements 36, 37 a molding plate 3 has been produced in the mold building device. After the compression elements 36, 37 have moved apart from one another, the molding plate 3 can be pushed to the conveyor belt 39 by means of a slide 28 and placed thereon.

The molding plates 4 and 5 can be pushed in, for example, from the other side of the conveyor belt 39 by the slides 29, 30. The various molding plates can be pushed in, for example, simultaneously because of the offset of the slides 28, 29, 30 relative to one another.

The molding plates 6, 7, 8 are already shown in the form of a layer stack on the conveyor belt.

The compression element 38 can regularly, for example, at equal intervals or controlled as required, press the molding plates 3, 4, 5 fed last against the already existing layer stack 6, 7, 8 in the stacking direction. The molding plates can then be clamped or glued together in order to hold them together. FIG. 9 shows molding plates without cavities for the sake of clarity, since only the infeed mechanism is to be illustrated here.

Figure 10:
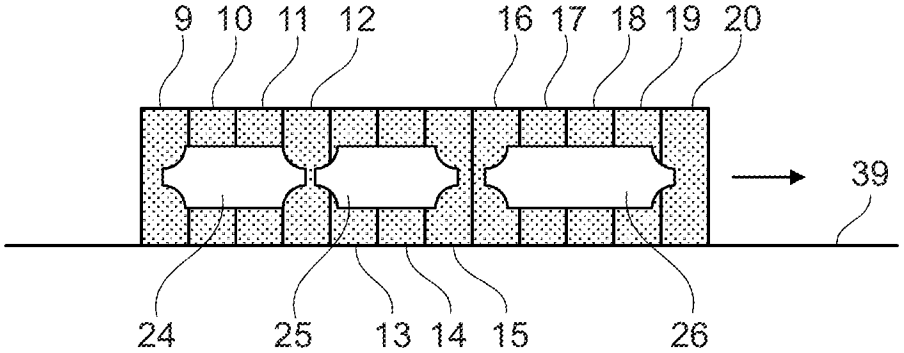
FIG. 10 illustrates a layer stack consisting of molding plates.

FIG. 10 shows a conveyor belt 39 in a side view with a layer stack of molding plates 9, 10, 11, 12, 13, 14, 15, 16, 17, 18, 19, 20. The individual molding plates have cavities that add up to cavities 24, 25, 26 of three casting molds in the layer stack. The two casting molds having the cavities 24, 25 overlap in a molding plate 12, which forms both a part of the first casting mold 9, 10, 11, 12 and a part of the second casting mold 12, 13, 14, 15. The third casting mold 16, 17, 18, 19, 20 has no common molding plates with further casting molds.

Figure 11:
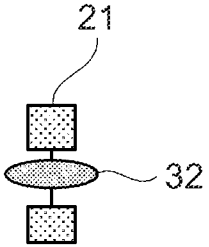
FIG. 11 illustrates a molding plate having a casting core.

It can be seen from FIG. 11 that cores 32 can also be arranged in the cavities of the layer stack. Said cores 32 can be connected to the molding plates 21 by means of webs or else be suspended in the molding plates by strand-like elements such as threads or wires. Said strand-like elements can also consist of materials that can be different from the material of the respective molding plate. After demolding, the strand-like elements can be pulled out of the casting and the openings can be filled or used for other purposes, such as the passage of electrical or optical fibers.

It can be seen from FIG. 11 that the dimensions of the cores can exceed the outer dimensions of an individual molding plate. In particular, in the stacking direction, a core can protrude beyond a molding plate in one or both directions.

Figure 12:
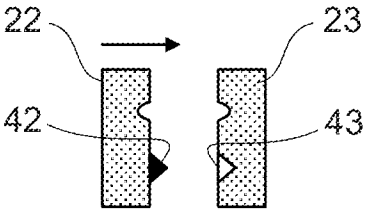
FIG. 12 illustrates two molding plates having positive-locking elements.

FIG. 12 shows two molding plates 22, 23 having recesses which are directly adjacent to one another in a layer stack to be molded. Positive-locking elements 42, 43 in the form of a web and a groove or a cone and a conical bore are provided on the molding plates, which positive-locking elements 42, 43 enable the two molding plates to be aligned with one another in the layer stack.

Figure 13:
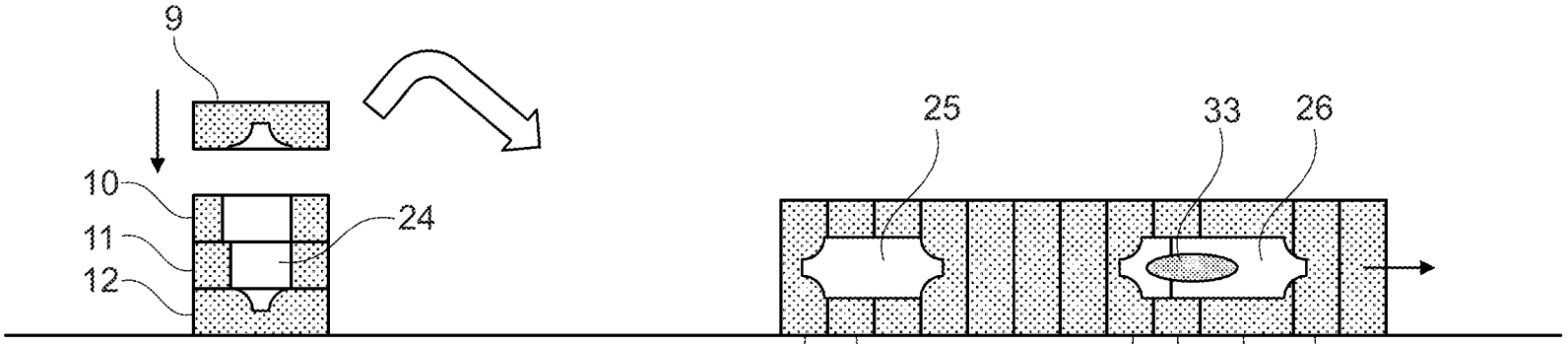
FIG. 13 illustrates a vertically stacked layer stack which, after being layered, is rotated by 90° and joined together with further mold elements.

FIG. 13 shows a layer stack of four molding plates 9, 10, 11, 12 in the process of being assembled. After joining together, as shown in the figure, the stack can be tilted so that the stacking direction runs in the horizontal direction, and then the layer stack 9, 10, 11, 12 can be attached to the molding plate 13 of the layer stack already lying on the conveyor belt 39 and be pressed against it. The stack 9, 10, 11, 12 can also be used as a casting mold in the vertical stacking direction and filled with casting material.

A core 33 fastened to the molding plate 17 is shown as an example in the cavity 26 of the molding plates 16, 17, 18, 19.

Figure 14:
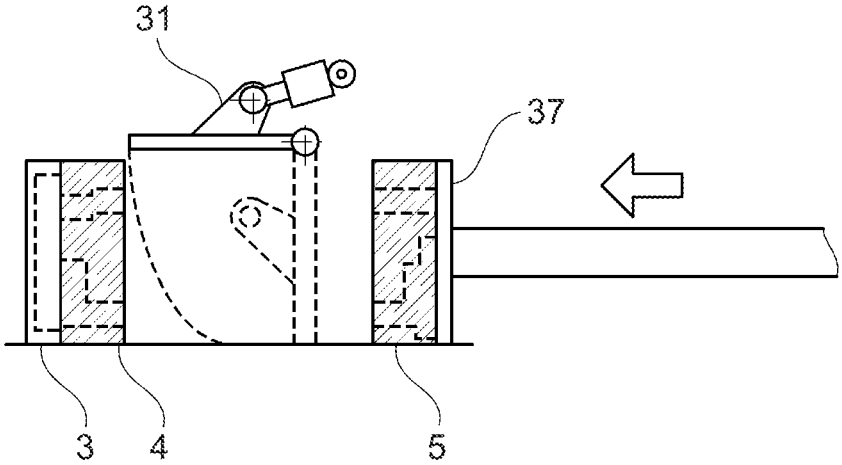
FIG. 14 illustrates a part of a layer stack of molding plates with a compression element in a side view.

FIG. 14 shows a step in joining together a layer stack with the molding plates 3, 4, 5, each of which has individual cavities. A compression cheek 31 folded up out of the space of the layer stack is shown, which compression cheek 31 serves to compress the molding plate 5 together using the compression element 37. After the molding plate 5 has been compressed, the compression cheek 31 can be raised and the finished molding plate can be pressed against the already existing layer stack 3, 4 by means of the compression element 37. The molding plates 5 can thus each be produced in a space-saving manner in the extension of the layer stack 3, 4 and pressed against it only in the stacking direction. A separate feed device is thus superfluous and the feed can be carried out by a compression element 37.

Figure 15:
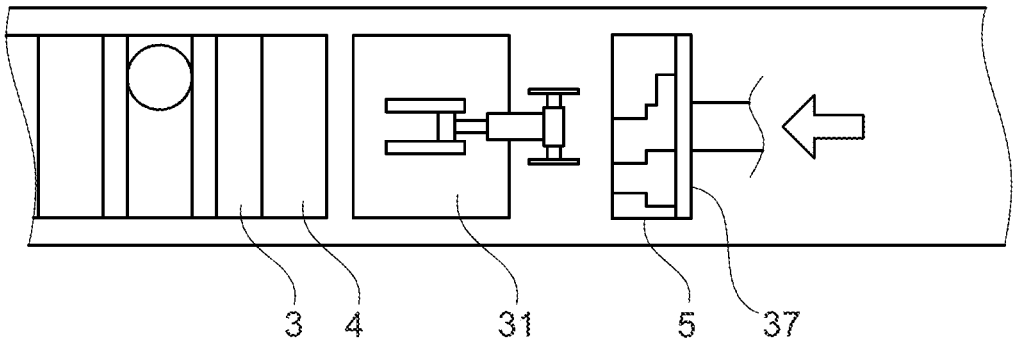
FIG. 15 illustrates the configuration of FIG. 14 in a view from above.

FIG. 15 is the device of FIG. 14 shown in a plan view.

Figure 16:
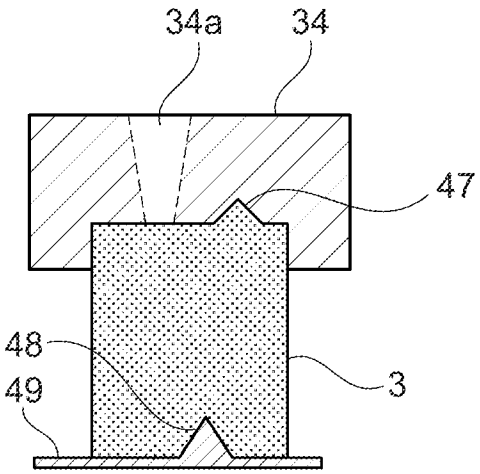
FIG. 16 illustrates a view of a molding plate in the stacking direction with a mold cover.

FIG. 16 shows, as an example, a cross-sectional representation, seen in the stacking direction, of a molding plate 3 having a positive-locking element 47 in the form of a web on its upper side. Said positive-locking element interacts with a complementary positive-locking element in the form of a V-groove in the fitted mold cover 34 for positioning.

Figure 17:
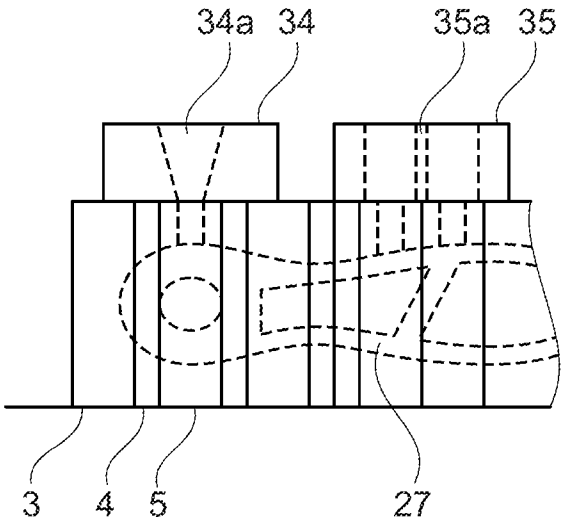
FIG. 17 illustrates a number of molding plates in a layer stack having a plurality of mold covers.

On its underside, the molding plate 3 has a V-groove which runs in the stacking direction and interacts with a cross-sectionally V-shaped web 48 on the base 49. With a correspondingly identical arrangement of grooves on the undersides of the molding plates, said molding plates can be assembled into layer stacks of molding plates 3, 4, 5, wherein FIG. 17 shows a coherent cavity 27 which is formed by the recesses of all molding plates together. The cavity 27 has various pouring openings leading to the top side of the layer stack and mold covers 34, 35 are placed on the molding plates with feeders 35*a* and funnels 34*a*, which end at the openings of the layer stack, so that a melt can be poured through the funnels/feeders into the cavity 27.

Figure 18:
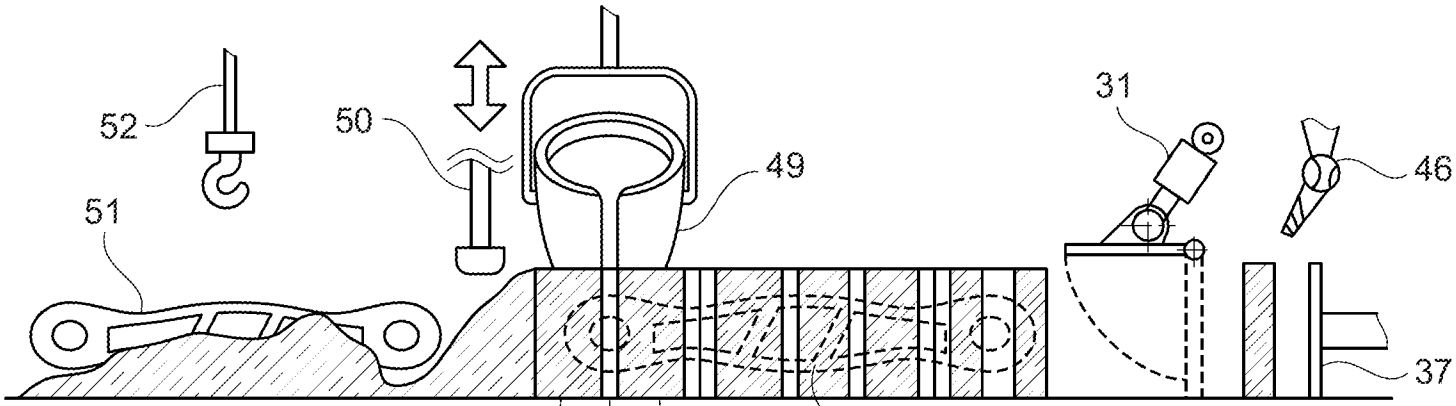
FIG. 18 illustrates a casting mold formed by a layer stack of molding plates during casting in the casting device and after demolding.

FIG. 18 shows an overview of a device for producing castings, wherein molding plates are first produced on the right side in a mold building device and are compressed by means of compression elements 31, 37. A machining tool 46 is also shown schematically.

The molding plates are then arranged thereon in a layer stack 3, 4, 5 corresponding to the layer stack having a cavity 27 shown in FIG. 17. A crucible 49 is further shown, by means of which a molten metal can be poured into the cavity 27 via various pouring openings. The layer stack 3, 4, 5 is successively moved to the left in FIG. 18. In a demolding device following the casting device, the material of the molding plates is crushed by an impact element 50 so that the cast component 51 is exposed and can be transported further by means of a crane 52.

The crushed material from the molding plates can be returned to the process and cyclically reused to produce new molding plates.

The presented device is thus able to carry out the entire process from the production of individual molding plates to the production of components by casting in an optimized manner and using the smallest possible number of molding plates. Molding plates of different dimensions and materials can be assembled into casting molds, wherein the selection of the molding plates used can be controlled ad hoc in the process. For example, molding plates having other recesses, external dimensions or more or less cooling properties, that is, controlled with regard to the thermal conductivity properties, can also be introduced into the layer stack in order to influence the cooling behavior of the melt during the production of the cast components.

For example, gravity casting or low-pressure casting can be implemented as the casting process.

In addition, components can be inserted into the individual molding plates, which components remain during the casting process and connect to the cast components or which can later be removed from the cast components in order to create targeted openings or complex recesses in the castings.

The inserted parts can, for example, also be strand-like elements made of fibers.

The invention claimed is:

1. A device for producing components comprising a mold building device for producing lost casting molds, and a casting device connected to the mold building device for casting the components in the lost casting molds, wherein the mold building device is configured for the continuous layering of molding plates, wherein a respective at least three of said molding plates form a lost casting mold of the lost casting molds, wherein the mold building device is configured to at least temporarily change a stacking direction in such a way that a vertical stack of molding plates is adjacent to a horizontal stack of molding plates.

2. The device according to claim 1, wherein the mold building device is suitable for producing the molding plates individually, which each delimit a cavity of the lost casting mold on at least one of their sides.

3. The device according to claim 1, wherein the mold building device has an infeed device for moving individual molding plates of the molding plates to form a stack of molding plates, and at least one of (1) an alignment element on which the molding plates can be aligned, and (2) that the mold building device has at least one tool for shaping positive-locking elements on the molding plates, wherein the positive-locking elements each enable the alignment of a molding plate on a molding plate directly adjacent thereto.

4. The device according to claim 1, wherein a demolding device is downstream of the casting device.

5. The device according to claim 1, wherein the mold building device is suitable for producing the molding plates individually, which each delimit a cavity of a lost casting mold of the lost casting molds on at least two of their sides.

6. A method for producing castings, in which first molding plates are produced and automatically continuously layered in a mold building device, a respective casting mold being formed by at least three molding plates delimiting a common cavity, wherein a stacking direction is at least temporarily changed and a vertical layer stack of molding plates is rotated by 90 degrees after it has been layered and is joined together with further mold elements, and a casting material then being poured into the casting molds within a casting device connected to the mold building device.

7. The method according to claim 6, wherein the mold building device is arranged in a fixed manner and that the individual molding plates are at least one of (1) placed on a drivable conveying element and (2) that the molding plates layered to form casting molds are moved relative to the casting device by means of a drivable conveying element.

8. The method according to claim 7, wherein the drivable conveying element comprises a conveyor belt.

9. The method according to claim 6, wherein at least one of (1) an infeed device of the mold building device moves along a stack of molding plates and (2) that a crucible of the casting device moves along the stack of molding plates in order to activate individual casting molds.

10. The method according to claim 6, wherein at least one of (1) the individual molding plates of the molding plates are each used for a plurality of adjacent casting molds and (2) that casting cores are also integrated into the molding plates.

11. The method according to claim 6, wherein after the layering, mold covers, each having at least one of a funnel and a feeder, are placed on one or more molding plates such that the at least one of the funnel and the feeder is connected to at least the common cavity of the respective casting mold.

* * * * *